United States Patent [19]

Allen et al.

[11] Patent Number: 4,851,156

[45] Date of Patent: Jul. 25, 1989

[54] RETENTION OF RADIO-RUTHENIUM IN ACID PROCESSING OF NUCLEAR WASTE

[75] Inventors: Charles R. Allen; Wilbur O. Greenhalgh, both of Richland; Richard G. Cowan, Kennewick, all of Wash.

[73] Assignee: The United States of America as represented by the United States Department of Energy, Washington, D.C.

[21] Appl. No.: 185,717

[22] Filed: Sep. 10, 1980

[51] Int. Cl.[4] ..... G21F 9/16; G21F 9/08; G21F 9/14; G21F 9/32

[52] U.S. Cl. ..... 252/629; 110/342; 252/632

[58] Field of Search ..... 252/626, 629, 631, 632; 110/237, 238, 342, 341; 501/152, 158

[56] References Cited

U.S. PATENT DOCUMENTS

| | | | |
|---|---|---|---|
| 3,120,493 | 2/1964 | Clark et al. | 252/629 |
| 3,957,676 | 5/1976 | Cooley et al. | 423/20 |
| 4,009,990 | 3/1977 | Bonniaud et al. | 252/629 |
| 4,053,432 | 10/1977 | Tiepel et al. | 252/626 |
| 4,202,792 | 5/1980 | Kaufmann et al. | 252/629 |

FOREIGN PATENT DOCUMENTS 5043430 3/1980 Japan .

OTHER PUBLICATIONS

Wood et al., Inorganic Chemistry, Butterworths, London (1960).

*Primary Examiner*—Howard J. Locker
*Attorney, Agent, or Firm*—Joyce L. Morrison; R. D. Fuerle

[57] ABSTRACT

Radioactive combustible waste can be processed with hot concentrated sulfuric acid and the resulting residue material immobilized in glass with retention of volatile radio-ruthenium, if present. In addition, the process features minimal material handling. The process combines a sulfuric acid digestion treatment of waste with a drying, desulfation, and glassification of the resulting acid residue into a non-dispersible solid of reduced volume. An optional ceramic product can be made without desulfation of the residue.

10 Claims, No Drawings

RETENTION OF RADIO-RUTHENIUM IN ACID PROCESSING OF NUCLEAR WASTE

BACKGROUND OF THE INVENTION

Disposal of nuclear wastes is an important problem in the nuclear energy field today since many radioactive wastes must be stored for very long periods to assure that no health hazard will occur. Low level nuclear combustible solid waste materials are a particular problem because of the relatively large bulk of materials associated with small amounts of contamination. Typical combustible solid waste materials of concern are those resulting from fuel fabrication operations, such as used rubber gloves, paper, rags, metals, glassware, brushes, and various plastic. Of particular concern as well is the disposal of spent ion exchange resins from reactors, fuel fabrication plants, and reprocessing plants, estimated to comprise from 500 to 800 cubic feet of material per year per nuclear reactor.

Present practice consists of packaging these solid waste materials in containers ranging from cardboard boxes lined with plastic bags to steel drums, then burying the packages in pits or trenches. This technique involves difficult and expensive handling of the scrap materials, transporting the packaged materials over roadways and finally storing the materials in monitored repositories or burial grounds. Potential release of contamination to the environment is possible as a result of the rapid decay of the containers, or inadvertent combustion, etc. Moreover, in fuel representing plants and fuel preparation plants, spent ion exchange resins contain significant amounts of plutonium as well as other fission products which may preclude direct burial of these resins, and require monitored retrievable storage.

A large percentage of the contaminated solid waste material is simply light-weight, bulky combustible material. Incineration of nuclear solid waste materials has been studied extensively, but it is subject to poor control of combustion, with attendant off-gas system difficulties and severe corrosion problems, coupled with rather expensive maintenance problems. Mechanical compaction of the solid waste material has also been studied extensively with volume reductions of two to ten-fold being achieved. In general, however, compaction and sorting of nuclear solid waste materials are moderately expensive in that special personnel protection devices are needed over and above normal protective equipment costs. Also, compacted solids are readily dispersible in the environment and can generate gases which under certain circumstances may constitute a safety hazard until properly disposed of in an engineered controlled and monitored area.

Acid digestion volume reduction methods appear to have some advantages over incineration, namely more efficient off-gas handling, and generally better reliability and longevity of essential hardware exposed to radioactive materials. Other advantages include a lack of buildup or accumulation of activity in refractory linings, and no generation of a liquid waste stream requiring further treatment. Combustible waste can be wholly digested with acid to an inert, non-combustible residual fraction. This very high sulfated residue fraction is wet with sulfuric and nitric acids but can be immobilized as a high integrity low leachable and low dispersible glass solid. The method involved removal of the acids, solids milling, desulfation of the residue using carbon fines at 700° to 900° C., and glassification of the desulfated material after adding appropriate glass formers and heating to at least 1050° C. The acid digestion waste treatment combined with a residue immobilization process complete the plant processing cycle. Large volumes of easily dispersible waste solids are converted to a small volume (20% reduction) of non-dispersible product compatible with presently used packaging methods. Conversion of the wastes to a non-leachable, non-dispersible solid is desired in order to provide an added safety factor, and possibly lower ultimate cost, in permanent storage.

For some nuclear waste residues, glass-forming additives such as phosphates or borates and lime or magnesia have been employed to obtain a vitreous nonleachable product with good mechanical strength and thermal conductivity. A major difficulty in these processes which form solids containing fission-product contamination has been the tendency of radio ruthenium to volatize, both during evaporation, and calcination, or fusion. For example, in the absence of control measures, ruthenium is normally volatized to the extent of 20 to 60 percent in calcining at the elevated temperatures, i.e., above 850° C., required for producing a ceramic or above 950° C. for a glassy solid. The volatized ruthenium, in the form of fission-product isotopes, ruthenium 103 and ruthenium 106, represents a substantial portion of the gamma activity of these solutions, and off-gas systems are thus severely contaminated. In some solids-forming processes, the volatilized ruthenium has been collected on silica gel or ferric oxide beds and the loaded beds subsequently combined with the calciner product. This procedure, however, is undesirable because of contamination of process equipment and the additional handling of highly radioactive materials required. Other problems preclude addition of phosphates to acid digestion methods due to the serious corrosion problems caused by them. Minimization of nitric acid concentration, pressure, and temperature in evaporation has been employed to minimize volatilization. These measures, however, have not been fully effective in the preparation of glass-like, non-leachable solids where a temperature of at least about 950° C. is required. Ruthenium off-gas losses of 50% or more are common.

SUMMARY OF THE INVENTION

An acid waste processing and immobilization method has been device that will simplify some of the process transfer and material handling steps of the present system described in a previous section, and which exhibits retention of about 90% of the radio-ruthenium which is volatile in present acid digestion and incineration processes. Combustible nuclear waste is reacted with sulfuric acid at reaction temperatures up to 330° C. The hot sulfuric acid decomposes the waste to gaseous components and carbonized particulates (agitation is also helpful). The carbonized material disperses in the acid to act as a reducing agent that prevents ruthenium from being oxidized to the volatile form. The carbon material also serves a dual purpose of being a reductant for sulfates, and so once the acid is removed from carbonaceous residue, it can be desulfated directly. This simplifies the immobilization portion of the process by eliminating a solids milling an a graphite addition and mixing step. The desulfated residue is then heated to the higher temperature of about 1100° C. and fused into a glass product.

PRIOR ART

The use of sulfuric acid with a toxic selenium catalyst to reduce the volume of combustible low level radioactive waste is described in "Treatment of Combustible, Solid, Low-Level Radioactive Waste at RISO, the Danish Atomic Energy Commission Research Establishment," by I. Larsen, in the Proceedings of a Symposium or Practices in the Treatment of Low and Intermediate Level Radioactive Waste, IAEA and ENEA, Vienna, December 1965.

U.S. Pat. No. 3,957,676 discloses the treatment of nuclear solid waste material with concentrated sulfuric acid at 230° to 300° C. The waste is simultaneously or later treated with nitric acid or nitrogen dioxide.

U.S. Pat. No. 3,120,493 discloses the suppression of volatile ruthenium compounds in radioactive waste by treatment with nitric acid by providing phosphite or hypophosphite ion (incompatible in our hardware) to form phosphate glass-like solids at elevated temperatures.

DESCRIPTION OF THE INVENTION

The combustible nuclear waste material that is treated by the process of this invention consists of gloves, paper, rags, and the like. A typical waste composition is about 35% by weight cellulose, 25% rubber, and 40% plastic. The ruthenium and other radioactive elements in the waste material are generally not in a volatile state, but are volatilized during nitric acid processing or air incineration.

It was determined that use of a different acid digestion technique wherein the waste would not be fully digested, but rather reduced to a degraded carbonaceous state, combined with modified immobilization steps could result in a complete waste treatment method with certain advantages over the prior art process. Our new waste treatement-immobilization process includes the following steps: (a) the quantity of glass formers or frit is estimated per unit of waste and is fed into the process concurrently with the waste, (b) the waste is agitated with hot concentrated sulfuric acid (92% at temperatures greater than 250° C.) which converts the waste into particulate carbon material plus inert residue, (c) the acid is removed by centrifugation and evaporation methods, (d) the material is desulfated by heating to 700° to 900° C. until evolution of sulfur dioxide and similar gases ceases, (e) the material is glassified by heating the material to about 1100° C. for at least two hours, and (f) the product is slowly cooled down to room temperature and the glass cannisters packed in drums for removal to a disposal area. The new method eliminates most of the mechanical handling operations of the immobilization part of the prior art process. If the process is also used to treat reactor combustible waste or other wastes with fission-product contamination, our process has the additional advantage of retaining the bulk of normally volatile ruthenium radionuclides in the final glass product. Other common fission-product radionuclides routinely encountered, such as cesium, strontium, cerium, etc. are considered to be reasonably stable in a sulfate, metal oxide, or glass matrix. The amount of concentrated sulfuric acid used should be about 5 to about 12 liters of sulfuric acid per kilogram of waste material. The mixture of waste material and concentrated sulfuric acid should be heated at a temperature near but below the boiling point of the sulfuric acid. A typical temperature range is about 250° to about 330° C. Lower temperatures take too long and higher temperatures require pressurized equipment. The preferred temperature range is about 300° to about 325° C. if appropriate corrosion resistant materials can be found. The waste reacts initially quite rapidly resulting in finely dispersed carbon. A feed state of about 1.5 pounds per hour per gallon of acid is probably realistic. Typically, about 30 minutes are needed for this reaction. The carbon primarily prevents volatile ruthenium compounds such as ruthenium tetroxide from forming and if formed, they are reduced to non-volatile oxides: $RuO_4+C \rightarrow RuO_2+CO_2$ and $4RuO_4+5C \rightarrow Ru_2O_3+5CO_2$.

In the second step of the process of this invention, the excess sulfuric acid is removed from the waste material. Removal is preferably accomplished by evaporation because it treats both dissolved and suspended solids. Evaporation can be enhanced by centrifugation to reduce the energy requirements and recycle the acid faster. The acid that is removed is preferably recovered and is recycled. Evaporation is preferably performed at a temperature of at least about 350° C. as lower temperatures are too slow, and below a temperature of 450° C. because higher temperatures are unnecessary.

The next step, desulfating the residue, is considered to be necessary if the waste is contained in glass because a leachable sulfate second phase can occur during glassification if sulfate is not removed. However, for other waste forms such as ceramics, cement, or polymers, desulfating is optional but does improve volume reduction. Desulfating requires a temperature of at least about 700° C., but temperatures in excess of 900° C. should not be used as glazing may prevent removal of the sulfates resulting in a second phase formation during glassification. The residue should be heated until sulfur dioxide is no longer evolved to complete the desulfating step. The sulfate is removed by reaction with the carbon that is present:

$$2M_xSO_4+C \rightarrow 2SO_2+CO_2+2M_xO$$

where M is sodium, calcium, iron, or other metal, and x is 2 divided by the valence of M.

In the next step, which is optional, the residue is contained in glass or ceramic. If this step is to be used, glass formers must be added to the residue at any previous step in the process. The glass formers are the reagents used in making glass, i.e., silicon, boron, sodium, and aluminum. The glass is a low leachable borosilicate glass. Typically, 10%, though it may vary from 2 to 20% by weight glass former (based on total solids, including glass former), is needed. The temperature range required for glass formation will depend on the type of glass used, but a range of about 1050° C. to 1150° C. is usually suitable, and a temperature over 1200° C. is unnecessary and may damage the container. The desulfating step and the glassification step can be run concurrently with the same equipment to minimize energy usage. The glass containing the dispersed radioactive residue can be melted directly in cans used for immobilization, and then placed in drums and sealed for storage or disposal.

The following example further illustrates this invention.

EXAMPLE

About 0.2 kg. borosilicate glass formers consisting of about 30% $SiO_2$, 33% $Na_2B_4O_7$, and 3% $Al_2O_3$ were added per kilogram of nuclear waste material using 100 gram samples of the shredded waste material. The waste material consisted of 35% cellulose, 25% rubber, 40% plastic, and about 5% ruthenium as $RuCl_3$. Sufficient concentrated sulfuric acid was added (about 1000 ml. for each 100 gms. of waste treated) to fluidize the waste. The mixture was heated at 300° C. for one hour which formed a carbon dispersion.

A sample of the residue was then assayed to determine the ruthenium loss, which was determined to be 1%. The residue was then heated at 400° C. for 4 hours to evaporate the sulfuric acid.

To remove the sulfates, one sample of the residue was heated at 700 to 800° C. for 2 hours. An assay at that time determined that the ruthenium loss was an additional 10%. This sample was then heated at 1100° C. for 2 hours to form glass. No additional loss of ruthenium occurred during the formation of the glass.

Another sample which had not been desulfated was pressed into a wafer at 1000 psi at room temperature. The wafer was then sintered at 800° C. for 2 hours to form a ceramic. This resulted in an additional loss of 4% of the ruthenium. Thus, the ceramic treatment had a total retention of ruthenium of 95 to 96% while the glass treatment had a retention of 89 to 90%.

We claim:

1. A nitric acid free method of processing combustible nuclear waste material so as to retain volatile radionuclides, said method consisting of the steps of:

(1) heating and agitating said nuclear waste material with about 5 to about 12 liters of concentrated sulfuric acid per kilogram of said nuclear waste material at a temperature between about 250° C. and about 330° C. to form dispersed elemental carbon, in an environment which permits said elemental carbon to reduce said volatile radionuclides to nonvolatile forms; and (2) removing said acid from said nuclear waste material by heating at a temperature between about 350° C. and about 450° C., thereby evaporating said sulfuric acid.

2. A method according to claim 1 including the additional steps of adding about 2 to about 20% borosilicate type glass forming compounds to said waste material to form a mixture, desulfating said carbonized waste materials and fusing said mixture into a glass.

3. A method according to claim 2 wherein said desulfating is performed at 700° to 900° C. until sulfur dioxide is no longer evolved.

4. A method according to claim 2 wherein said glass is formed at about 1000° to about 1200° C.

5. A method according to claim 1 including the additional steps of adding borosilicate glass forming compounds to said waste material and sintering said glass forming compounds to form a ceramic.

6. A nitric acid free method of immobilizing radioruthenium-containing combustible nuclear waste material in glass so as to retain radioruthenium and dispersed radioactive residues within said glass, said method consisting of the steps of (1) agitating said waste material with about 5 to about 12 liters of sulfuric acid per kilogram of waste material, at a temperature between about 250° C. and about 330° C., whereby said waste is converted into particulate carbon plus an inert residue, and said carbon prevents volatile ruthenium compounds from forming and, if formed, reduces them to non-volatile compounds;

(2) evaporating said sulfuric acid from said waste material by heating at a temperature between about 350° C. and about 450° C.

(3) desulfating by heating at a temperature between about 700° C. and about 900° C. until sulfur dioxide is no longer evolved;

(4) adding, at any previous step in said process, about 2 to about 20% by weight glass formers, based on total solids, including said glass formers; and (5) heating at a temperature between about 1000° C. and about 1200° C. to form a glass and to contain dispersed radioactive waste therein.

7. A method according to claim 6 wherein said glass is formed in containers used for immobilization.

8. A method according to claim 6 wherein said glass formers are borosilicate type.

9. A nitric acid free method of immobilizing radioruthenium-containing combustible nuclear waste material in ceramic so as to retain radioruthenium and dispersed radioactive residues within said ceramic, said method consisting of the steps of (1) agitating said waste material with about 5 to about 12 liters of sulfuric acid per kilogram of waste material, at a temperature between about 25° C. and about 330° C., to form dispersed elemental carbon, whereby said waste is converted into particulate carbon plus an inert residue, and said carbon prevents volatile ruthenium compounds from forming and, if formed, reduces them to non-volatile compounds;

(2) evaporating said acid from said waste material by heating at a temperature between about 350° C. and about 450° C.;

(3) adding, at any previous step in said process, about 2 to about 20% by weight glass formers, based on total solids, including glass formers; and (4) pressing into a wafer; and (5) sintering said wafer to form a ceramic which contains dispersed radioactive waste therein.

10. A method according to claim 9 wherein said glass-formers are borosilicate type.

* * * * *